US007707936B2

(12) United States Patent
Schneider et al.

(10) Patent No.: US 7,707,936 B2
(45) Date of Patent: May 4, 2010

(54) MOVABLE FRAME PARTS IN A PRINTING PRESS

(75) Inventors: Georg Schneider, Würzburg (DE); Siegfried Alfons Stark, Rottendorf (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 454 days.

(21) Appl. No.: 10/575,677

(22) PCT Filed: Apr. 29, 2004

(86) PCT No.: PCT/EP2004/050651

§ 371 (c)(1),
(2), (4) Date: Apr. 13, 2006

(87) PCT Pub. No.: WO2005/037553

PCT Pub. Date: Apr. 28, 2005

(65) Prior Publication Data

US 2007/0144387 A1 Jun. 28, 2007

(30) Foreign Application Priority Data

Oct. 14, 2003 (DE) ..... 103 47 571

(51) Int. Cl.
*B41F 5/04* (2006.01)
*B41F 5/02* (2006.01)

(52) U.S. Cl. ..... 101/221; 101/217; 101/229

(58) Field of Classification Search ..... 101/177, 101/180, 182, 480, 483, 484, 216, 217, 219, 101/220, 221, 229; 292/95, 96, 102
See application file for complete search history.

(56) References Cited

U.S. PATENT DOCUMENTS 1,519,717 A * 12/1924 Bilodeau ..... 292/100

(Continued)

FOREIGN PATENT DOCUMENTS

CN 1081986 C 4/2002

(Continued)

*Primary Examiner*—Daniel J Colilla
*Assistant Examiner*—David Banh
(74) *Attorney, Agent, or Firm*—Jones, Tullar & Cooper, P.C.

(57) ABSTRACT

A printing unit of a printing press includes at least two frame parts whose distance from each other can be varied. Each of these frame parts include two laterally spaced frame plates. The two frame plates in each of the frame parts accommodate at least one cylinder or roller which extends between them. The two lateral frame plates in each frame part are spaced from each other in an axial direction of the supported cylinder or roller. Adjacent ones of the frame parts are connectable to each other by abutting of their respective lateral frame plates. At least three locking and/or centering devices are used to align and to lock together the lateral frame plates of adjacent ones of the frame parts.

29 Claims, 8 Drawing Sheets

U.S. PATENT DOCUMENTS

| | | | | |
|---|---|---|---|---|
| 4,244,109 | A * | 1/1981 | Silverman | 250/237 R |
| 5,060,569 | A | 10/1991 | Gladow | |
| 5,644,982 | A * | 7/1997 | Koura et al. | 101/216 |
| 5,718,172 | A | 2/1998 | Ruckmann et al. | |
| 5,782,182 | A | 7/1998 | Ruckmann et al. | |
| 2001/0037743 | A1 | 11/2001 | Takahashi | |
| 2002/0005133 | A1 * | 1/2002 | Detmers et al. | 101/480 |
| 2002/0195826 | A1 * | 12/2002 | Fountaine | 292/96 |
| 2004/0089177 | A1 | 5/2004 | Stiel | |

FOREIGN PATENT DOCUMENTS

| | | | |
|---|---|---|---|
| CN | 1085963 | C | 6/2002 |
| EP | 0 749 369 | B1 | 11/1997 |
| EP | 1 149 694 | A1 | 10/2001 |
| EP | 0 745 031 | A1 | 3/2005 |
| GB | 624303 | | 6/1949 |
| WO | WO 95/24313 | | 9/1995 |
| WO | WO 02/07972 | A1 | 1/2002 |

* cited by examiner

MOVABLE FRAME PARTS IN A PRINTING PRESS

CROSS-REFERENCE TO RELATED APPLICATIONS

This patent application is the U.S. National Phase, under 35 USC 371, of PCT/EP2004/050651, filed Apr. 29, 2004; published as WO 2005/037553 A1 on Apr. 28, 2005 and claiming priority to DE 103 47 571.0, filed Oct. 14, 2003, the disclosures of which are expressly incorporated herein by reference.

FIELD OF THE INVENTION

The present invention is directed to printing units of a printing press Each printing unit includes at least two frame elements whose distance, in relation to each other, can be changed. Each of these frame elements has two laterally spaced frame plates which support at least one cylinder or roller.

A printing unit is known from EP 0 749 369 B1, in which rollers are mounted in the movable frame element and rest on horizontal rails. These rollers also support the stationary frame element. In a printing unit of dimensions suitable for newspaper printing, the load resting on each roller of the movable frame element can reach an amount of several tons. Thus, extreme pressures occur at the contact faces between the rollers and rails on which they roll. While the rollers can be made of hardened steel, which can withstand being subjected to the occurring pressures, use of this hardened steel is difficult, in connection with the rails, because of their dimensions. However, if the rails are made of non-hardened steel the danger arises that the wheels may be pressed into the rails and it becomes impossible to move the movable frame element evenly, or to put it into motion at all.

U.S. Pat. No. 5,060,569 discloses a frame element which can be moved on rollers. The rails are raised for movement and the frame element rests on another frame element during operations.

EP 1 149 694 A discloses a printing press with movable frame elements. These frame elements are locked by hooks.

SUMMARY OF THE INVENTION

The object of the present invention is directed to providing printing units of a printing press.

In accordance with the present invention, this object is attained by the provision of a printing unit having at least two frame elements whose distance, in relation to each other, can be changed. Each of the frame elements has two laterally spaced frame plates which cooperate to support at least one cylinder or roller. The frame plates are spaced laterally from each other in a direction of an axis of rotation of the cylinder or roller. At least three locking and/or centering devices are used to fix in place the lateral frame plates of adjacent ones of the frame elements. The centering and locking devices can be positioned directly adjoining each other. One of the frame elements can be moved vertically with respect to the other.

Because of the retractability of the rollers, the possibility of displacing a weight resting on them at least partially to a contact surface different from the rollers is provided. The rollers are, in this way, relieved of the weight resting on them to the extent that the pressing of the rollers into a support need no longer be feared.

Since such a contact surface can easily be made larger than the contact surface which exists between a roller and a support, it is possible to decrease weight related pressure loads, even if the entire weight of the movable frame element is displaced to the contact surfaces which are different from the rollers. The demands made on the load carrying capability of a support on which the movable frame element is supported can be reduced.

The rails, on which the rollers rest in the extended state, are preferably also used as supports on which the contact surfaces, which are different from the rollers, are supported.

The contact surfaces can be constituted simply by the lower edges of lateral frame plates of the movable frame element.

Preferably, each frame element has at least one rubber blanket cylinder as the cylinder delimiting the printing gap, a forme cylinder and an inking system, so that the two rubber blanket cylinders, forme cylinders, and the like each constitute a printing unit in bridge construction suitable for recto- and verso-printing.

The displaceability of the rollers between their extended and the retracted positions is preferably achieved wherein each rotatable shaft of the associated roller is pivotably maintained on the movable frame element. A pneumatic or a hydraulic actuating member is preferably employed for driving at least one of the rollers in a pivot movement around its eccentric axis.

If two rollers, which can respectively be pivoted around a common eccentric axis, are arranged on a common torsion-proof shaft, a single actuating member can be employed for accomplishing the pivoting of both of the rollers. Tilting of the printing unit, during the retraction and extension of the rollers, can thus be avoided.

In connection with a movable frame element with two lateral frame plates, the two rollers, which can be pivoted around a common eccentric axis, are arranged in such a way that they each support different one of these frame plates.

Several rollers, and in particular those rollers which are running on a common rail or which are supporting the same frame plate, can be pivotably coupled by the use of a rod, which rod acts on shafts of the rollers via levers.

To fix the positions of the two frame elements in relation to each other in a working position, where they are not spaced apart, a protrusion is preferably formed on one of the frame elements. This protrusion is oriented in the movement direction of the movable frame element. A cutout, which is shaped in a complementary manner to the protrusion, is formed on the other frame element. The protrusion and the cutout will come into positive engagement with each other when the frame elements are arranged without a space between each other.

The protrusion or the cutout can automatically provide a centering effect when the frame elements are brought together. This is particularly effective if the protrusion is tapered towards its free end and/or the cutout tapers toward a bottom.

The protrusion is preferably shaped as a vertically oriented rib. The cutout is preferably shaped as a vertically oriented groove in order to define the position of the two frame elements relative to each other only in a horizontal direction transversely to the movement direction, but not in the vertical direction.

For use in guiding the movement of the movable frame element, least one upright guide rail is preferably provided. This guide rail extends in the movement direction of the movable frame element, is fixedly connected with one of the frame elements and is enclosed on two sides by a track guidance device of the other frame element. This track guidance device is preferably comprised of at least one pair of guide rollers, which roll off on the sides of the guide rail.

For use in moving the movable frame element, a toothed rack, which is extending in the movement direction of the movable frame element, is suitably mounted on one of the frame elements. On the other frame element, a self-locking drive mechanism is used to engage the toothed rack, which self-locking drive mechanism can be disengaged from the toothed rack in order not to block the movement of the movable frame element in case of an interference. The greatly geared-down drive mechanism is preferably accomplished with the aid of a worm gear. This worm gear drive is preferably pivotably attached to the frame for disengagement from the toothed rack.

To lock stationary and movable frame elements of the printing group together in their work position, at least one hook is preferably provided on one of the frame elements, which at least one hook can be brought into engagement with the other frame element. This at least one hook can be charged with a pulling force that is acting in a direction toward the one frame element. Preferably, the movable frame element is identical to the previously mentioned movable frame element, in addition to the frame element fixed in place on the frame, the stationary frame element can also include the support.

The hook preferably engages a roller of the other frame element. The hook's movement into the engagement position and out of the engagement position is not hampered by too strong frictional forces. A pneumatic or a hydraulic actuating member is preferably used for driving the hook in a pivot movement into the engagement position or out of it. The supply of the actuating member with pressure fluid is simplified if the frame element, to which the hook and the actuating member are attached, is the stationary frame element.

At least one hook should exert a pulling force, with a downward directed component, on the movable frame element in order to fix the latter in place also in the vertical direction.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
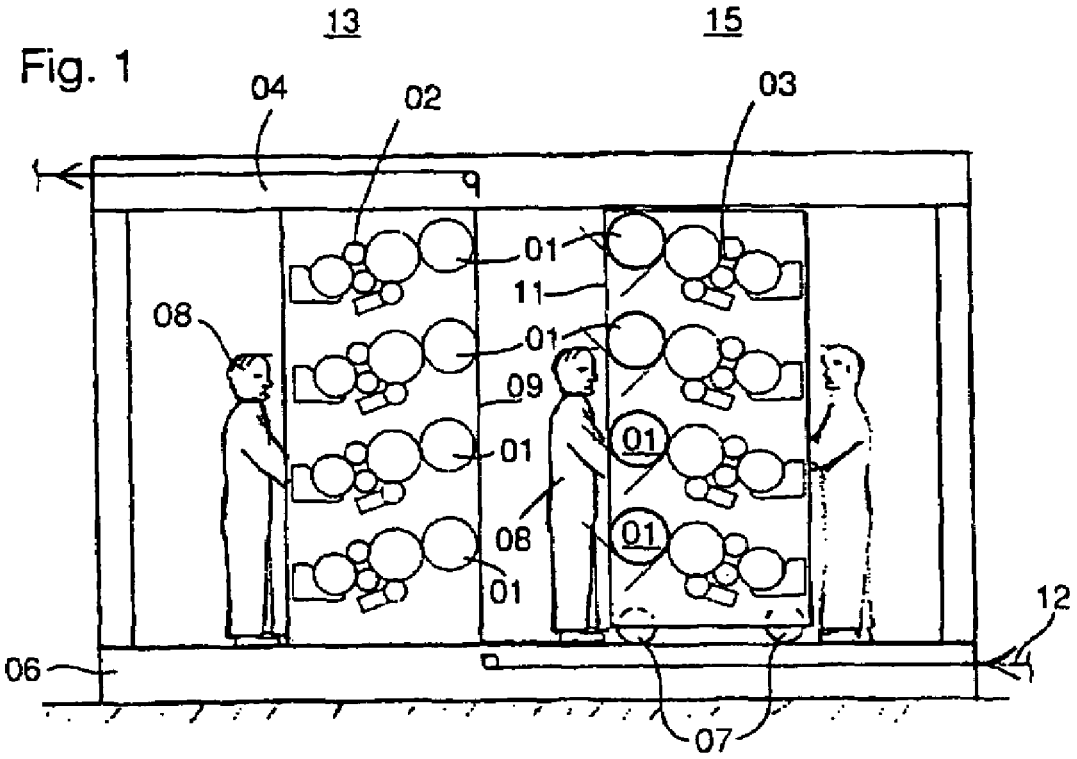
FIG. 1, a schematic side elevation view of a printing group with a movable frame element which is spaced apart from a stationary frame element, in FIG. 2, the printing group depicted in FIG. 1, with the movable frame element in a position wherein it is not spaced apart from the stationary frame element, and with rollers extended, in FIG. 3, the printing group in FIG. 1 with the rollers retracted in a work position, in FIG. 4, a schematic depiction of the suspension of the rollers from a lateral frame plate of the movable frame element, in an extended position, in FIG. 5, a schematic depiction of the movable frame element, with the rollers in the retracted position, in FIG. 6, a perspective view, from above, of a running gear of the movable frame element, as well as of rails of the stationary frame element on which the running gear moves, in FIG. 7, a schematic cross-sectional view through a wheel box of the running gear in accordance with FIG. 6, in FIG. 8, a drive mechanism for use in accomplishing the movement of the movable frame element along the rails, in FIG. 9, a schematic cross-sectional view through the drive mechanism depicted in FIG. 8, in FIG. 10, a schematic plan view of a locking mechanism for locking the frame elements together, in FIG. 11, a partial cross-sectional view, from above of the locking mechanism shown in FIG. 10, in FIG. 12, a schematic plan view of a locking mechanism for use in locking the movable frame element on the support, in FIG. 13, a schematic representation of a printing group with two movable frame elements and with one frame element fixed in place, and in FIG. 14, a schematic representation of a locked position of a printing unit in accordance with FIG. 13.
Figure 2:
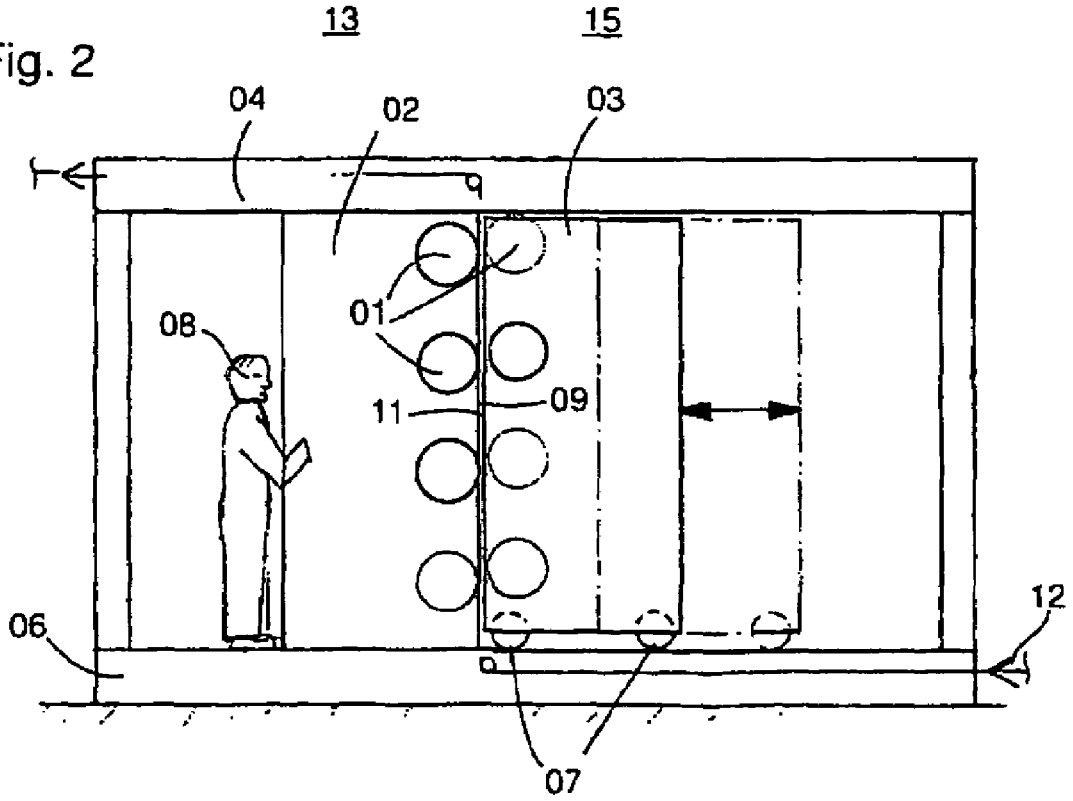
Figure 3:
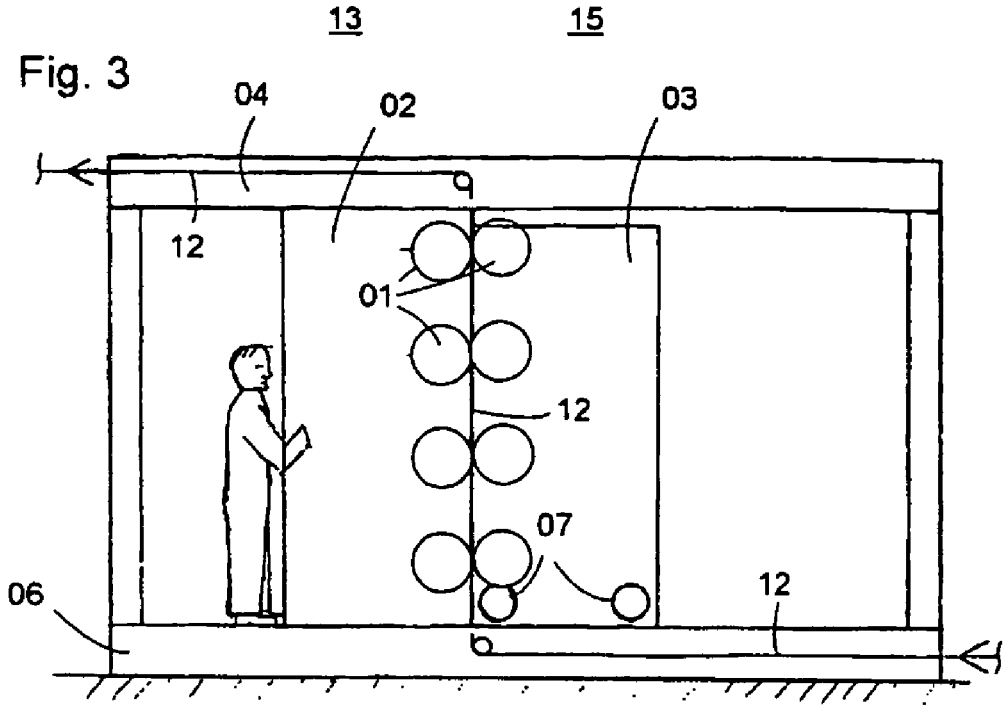

FIGS. 1 to 3 illustrate the basic operative principle of the present invention. A printing unit is shown and which is provided with four printing groups, which printing groups are arranged one above the other and which each have pairs of cylinders 01, such as, for example, rubber blanket cylinders 01 or rollers. In a manner which is known per se, a plate cylinder, an inking system and a dampening system are assigned to each rubber blanket cylinder 01. These cylinders and systems are maintained between respective lateral frame plates 02, 03. The interior structure of the printing groups will not be described in detail here, since such a description is not required for an understanding of the present invention. A description of this type of interior structure is provided in EP 0 749 369 B1, to which reference is hereby made.

The two spaced lateral frame plates 02, together with the cylinders 01 and the inking and dampening systems which they support, form a fixed frame element 13. This frame element 13 is fixed on a press main frame and is solidly mounted between upper and lower supports 04, 06 of that main press frame. The two spaced lateral frame plates 03, together with the cylinders 01, inking and dampening systems which they support, form a movable frame element 15. These two spaced lateral frame plates 03 are fixedly mounted between the upper and lower supports 04, 06, which are respectively constructed with parallel rails 05 which are transversely connected with each other, as may be seen in FIGS. 6 and 12. The two spaced lateral frame plates 03 are provided with rollers 07 on their lower edge, which rollers 07 can be displaced between an extended position and a retracted position. The two frame plates 03, together with the components maintained between them, form a movable frame element 15. FIG. 1 shows the rollers 07 in their extended position, in which extended position, rollers 07 keep the lateral frame plates 03 spaced apart from the rails 05 of the lower support 06. These rails 05 are, at the same time, used as a track, on which the rollers 07 roll off.

FIG. 1 shows the movable frame element 15 in an open or separated position in which it is spaced apart from the lateral frame plates 02 and in which spaced apart position an operator 08 can enter a space between the pairs of rubber blanket cylinders 01 and can perform maintenance work, such as a change of rubber blankets. Following the completion of the maintenance work, the movable frame element 15 is displaced toward the left in FIG. 1 until it reaches the closed or contiguous position represented in FIG. 2, in which closed position the stationary lateral frame plates 02 and the movable lateral frame plates 03 touch each other at respective edges 09, 11 that are facing each other. In this closed position, with rollers 07 still extended, the rubber blanket cylinders 01 of the movable lateral frame element 15 lie slightly higher than those of the stationary one. By bringing the rollers 07 into their retracted position, in which they no longer protrude past the lower edge of the lateral frame plates 03, the movable frame element 15 is lowered a further distance, as represented in FIG. 3, so that the lower edges of the lateral frame plates 03 now lie on the rails 05 of the support 06. In this closed, engaged position, the pairs of rubber blanket cylinders 01 respectively arrive at the same height and form a printing gap, in which a web 12 of material, such as, for example, a paper web 12, which is conducted between the blanket cylinders 01, can be imprinted.

While in the positions shown schematically in FIGS. 1 and 2, the rollers 07 support the entire weight of the movable frame element 15, including that of the lateral frame plates 03 and the cylinders 01 of the several printing groups which are held between them, and transfer that weight to a small surface of the lower support 06. In the position depicted schematically in FIG. 3, in which the entire lower edge of the lateral frame plates 03 rests on the lower support 05, the weight is distributed over a substantially greater area than the area which receives that weight when the frame element 15 is supported only by the rollers 07. The rollers 07 thus support the movable frame element 15 only when it is to be moved, and possibly if, as represented in FIG. 1, the movable frame element 15 is spaced apart from the stationary frame element 13 and the space between the frame elements 13, 15 is accessible. This spacing, and weight support by rollers 07 is occasioned only during comparatively short periods of time. During a printing operation, the lateral frame plates 03 rest with their lower edges on the lower support 06. Thus, there is no danger that the rollers 07 will press into the lower support 06, or that the rails 05 of the lower support 06 are damaged in other ways, so that the mobility of the movable frame element 15 would be hindered by this type of damage.

Figure 4:
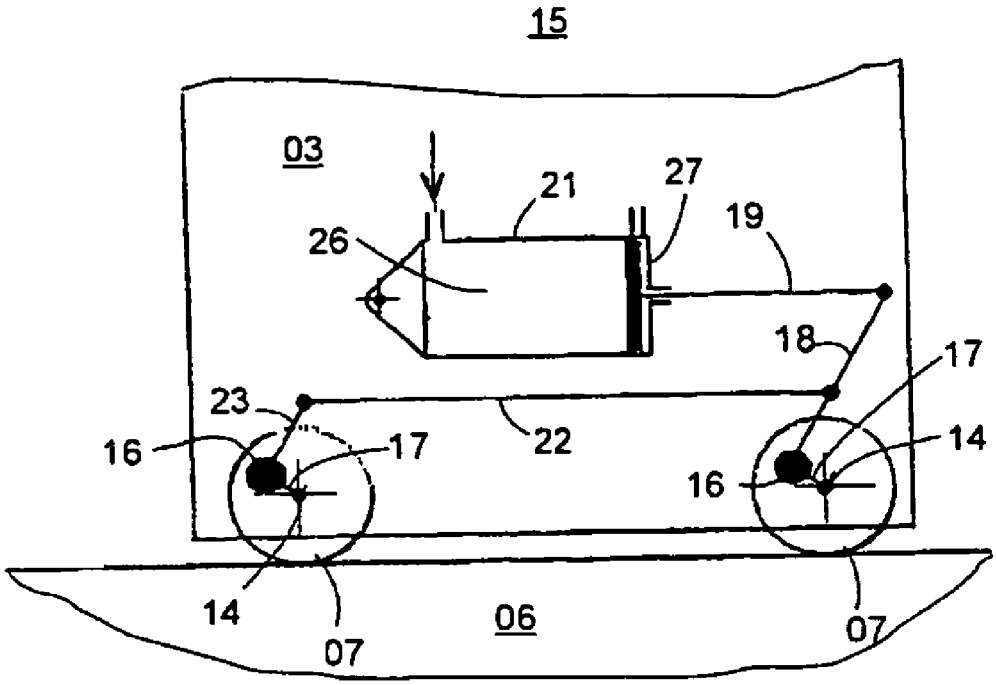
Figure 5:
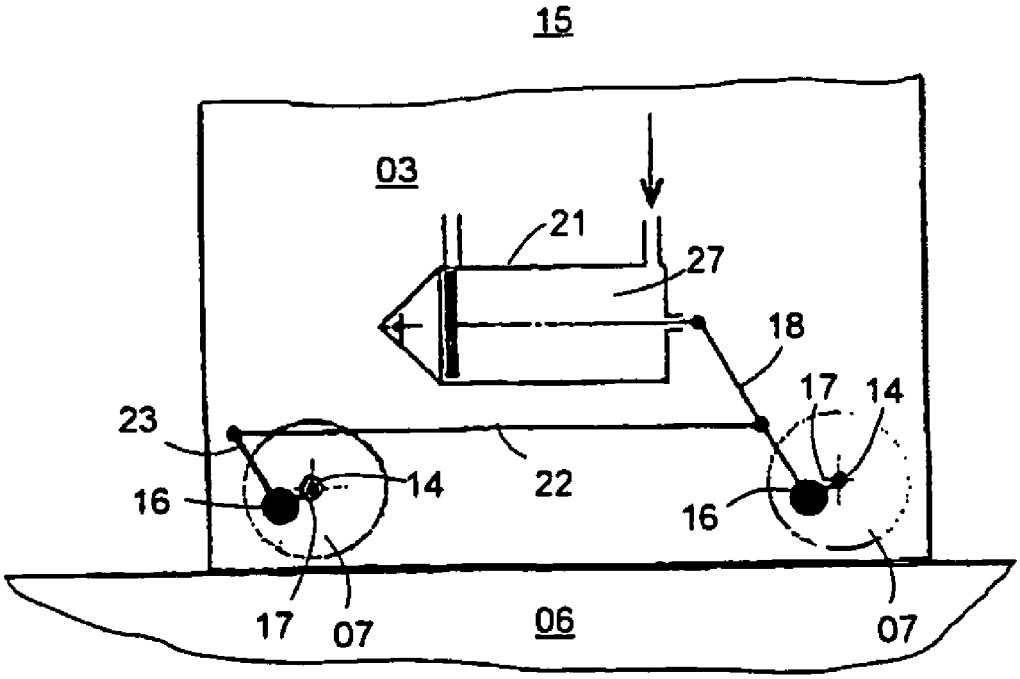

A preferred mechanism for retracting and for extending the rollers 07 is represented schematically in FIGS. 4 and 5. FIG. 4 shows the rollers 07 in the extended position, and FIG. 5 shows the rollers 07 in the retracted position. The rollers 07 have a rotatable shaft 14, which is hinged by the use of a first, pivot lever arm 17 on a pivot shaft 16, which pivot shafting is stationary with respect to the lateral frame plate 03. A second, actuating lever arm 18 is rigidly connected, at one end, with the first, pivot lever arm 17 of a right roller 07. A free end of actuating lever arm 18 engages a piston rod 19 of a pneumatic or a hydraulic actuating member 21, such as, for example, a hydraulic cylinder 21. One end of a rod 22, for example a synchronizing rod 22, is hinged to a free end of a third lever arm 23, which is rigidly connected with the first, pivot lever arm 17 of the left roller 07. A second end of synchronizing rod 22 is hinged to an intermediate point on the second, actuating lever arm 18. The distance of the intermediate point from the adjoining eccentric shaft 16, such as, for example, the pivot shaft 16, corresponds to the length of the third, working lever arm 23, so that the second and third lever arms 18, 23, which are coupled to each other by the synchronizing rod 22, always perform the same rotating movement. In the position depicted in FIG. 4, a first chamber 26 of the hydraulic cylinder 21, which is facing away from the piston rod 19, has been put under pressure, so that the piston rod 19 is extended out of actuating member 21 as far as a stop and this maintains the rollers 07 in the extended position. The piston rod 19 is slowly retracted, into member 21, by the controlled release of pressure gas from the chamber 26. The rollers 07 pivot in a counterclockwise direction around their pivot shafts 16 until the lower edge of the lateral frame plate 03 rests on the support 06. When the rollers 07 are in the retracted position, in which they rest loosely on the support 06, they can be lifted off the support 06 into the position represented in FIG. 5 by charging a second chamber 27 of the hydraulic cylinder 21, which second chamber 27 is facing the piston rod 19.

Figure 6:
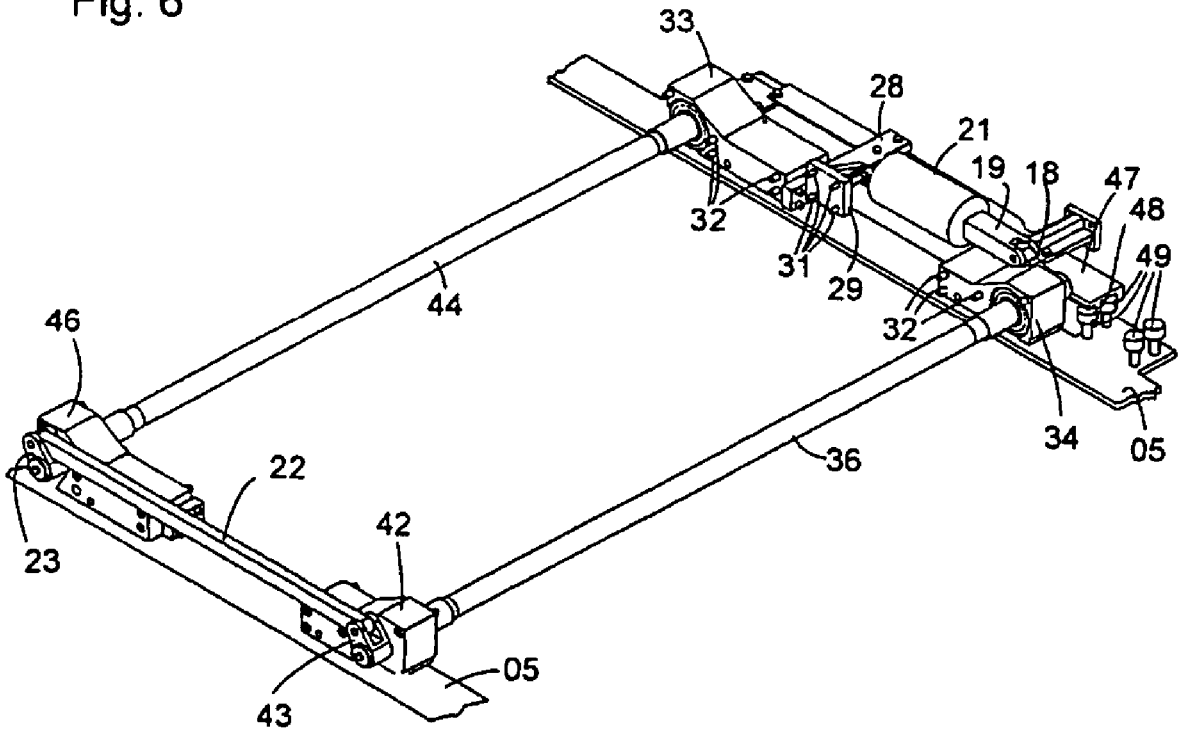

FIG. 6 shows a detailed representation of a running gear of the movable frame element 15, as well as of two rails 05 of the lower support 06 on which the running gear can be moved. The previously described hydraulic cylinder 21, the piston rod 19 and the actuating lever arm 18 can be seen in FIG. 6. The end of the hydraulic cylinder 21, which is facing away from the piston rod 19, is connected with a horizontal arm 28 that is extending from a flange 29, from whose side facing away from horizontal arm 28, four pins 31 project. These pins 31 are screws 31, which are used for securing the flange 29 to one of the two lateral frame plates 03 of the movable frame element 15, which lateral frame plates 03 are not represented in FIG. 6. Corresponding pins 32, or screws 32, that are used for the same purpose, protrude past the lateral walls of two wheel boxes 33, 34. Each one of the wheel boxes 33, 34 contains one of the previously discussed rollers 07.

Figure 7:
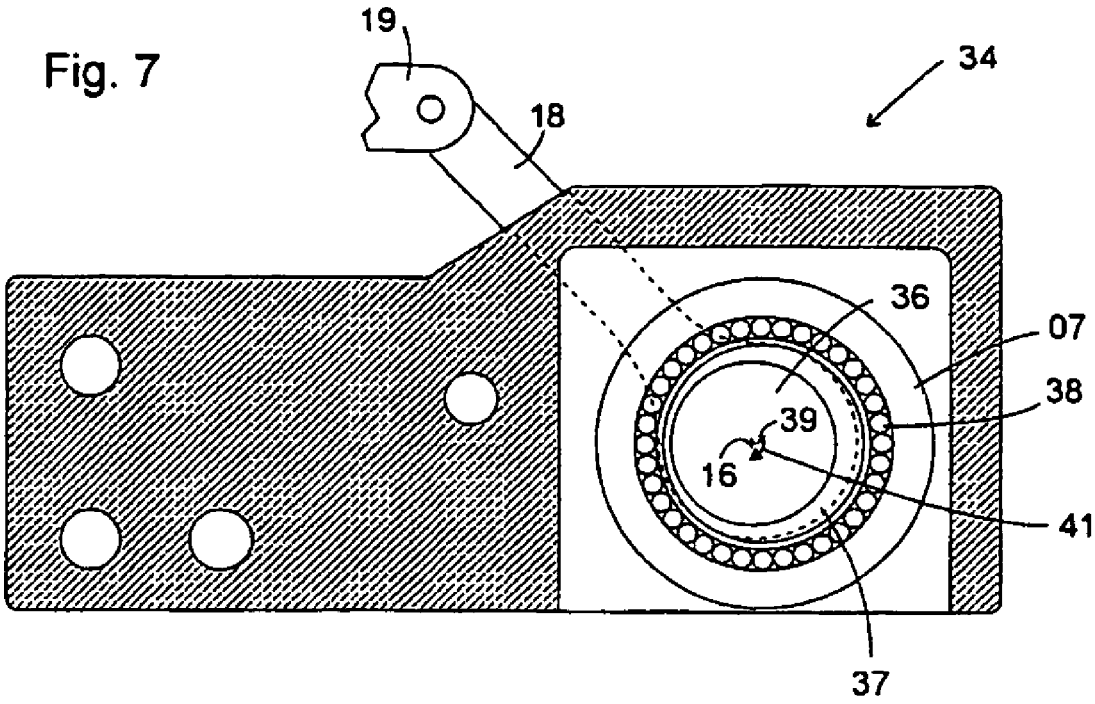

A schematic section through the wheel box 34 is represented in FIG. 7. The location of the pivot shaft 16 is indicated by a cross. It is also the longitudinal axis of a shaft 36, for example a pivot shaft 36, which is extending transversely through the wheel box 34, at which point the actuating lever arm 18, which is connected with the piston rod 19, acts on the pivot shaft 36 outside of the wheel box 34. The first, pivot lever arm 17 is realized by an eccentric sleeve 37, whose interior bore encloses the pivot shaft 36 and is fixed to pivot shaft 36 against relative rotation, and whose exterior circumference supports the roller 07 by the use of a bearing 38, such as, for example, a rolling bearing 38. The center of the exterior circumference of the sleeve 37, which defines the axis of rotation of the roller 07, is identified by a cross at 39, as seen in FIG. 7. If the lever arm 18 is rotated in a clockwise direction, the center of sleeve 37 and of the rotatable shaft 36 moves along the arrow 41, so that a portion of the running face of the roller 07 emerges from the open underside of the wheel box 34.

As is shown in FIG. 6, the pivot shaft 36 extends, starting at the wheel box 34, transversely underneath the movable frame element 15 and crosses through a second wheel box 42, on which a second roller 07 is mounted in the same way as in the first wheel box 34. The second roller is positioned on the second lateral frame plate 03 in a manner the same as is used to secure the first roller 07 and the first wheel box 34 to the first lateral frame plate 03 of the movable frame element 15.

The synchronizing rod 22 acts on the one hand via a working lever arm 43, and on the other hand via the lever arm 23, on the pivot shaft 36, as well as on a second shaft 44, for example a second pivot shaft 44, which is parallel with the first pivot shaft 36 and which passes through the wheel boxes 46 and 33. The movements of all of rollers 07 between the extended or retracted position are coupled to each other by the synchronizing rods 22 and by the continuous rigid pivot shafts 36, 44.

A guide rail 47, which is provided with an F-shaped cross section, is rigidly connected with the two wheel boxes 33, 34, as seen in FIG. 6. This guide rail 47, which can be displaced together with the movable frame element 15, has a vertically downward directed rib 48 which, in case of a displacement of the frame element 15, moves with contact between two pairs of guide rollers 49. These guide rollers 49 are mounted on one of the support rails 05 and are remote from a rolling surface of the support rail 05 over which the rollers 07 move. The cooperation between the guide rail 47 and the guide rollers 49 enforces an exactly linear movement of the movable frame element 15 along the support rails 05, without the possibility of an offset of the movable frame element 15 transversely to the longitudinal direction of the rails 05. Although they are not specifically represented, a corresponding guide rail 47 and guide rollers 49 can also be mounted on the wheel boxes 42, 46, or on the lower support 06 of the main press frame which, as depicted in FIG. 6, faces the viewer.

Figure 8:
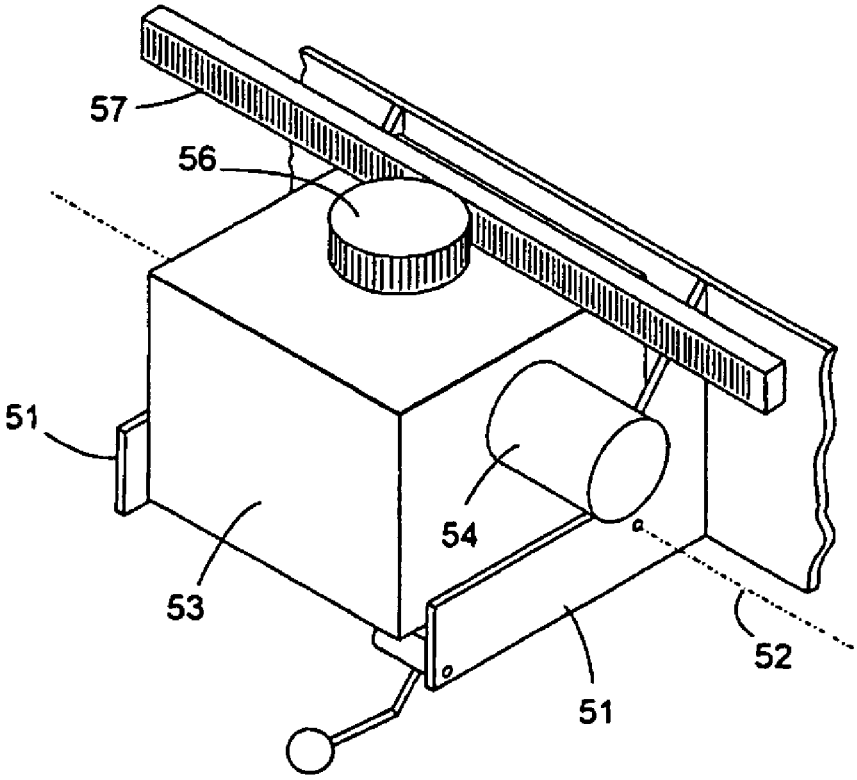

The drive mechanism, which is represented in a perspective plan view in FIG. 8, is mounted on the running gear, or on one of the lateral frame plates 03 mounted thereon, of the movable frame element 15. Two rigid arms 51 project transversely, with respect to the movement direction of the movable frame element 15 away from the running gear, or away from one of the lateral frame plates 03. Between them, these arms 51 support a drive unit 53, which is hingedly suspended from a shaft 52 and which drive unit 53 has a motor 54, such as, for example, an electric motor 54, which electric motor 54 drives an output gear wheel 56 via a self-locking reduction gear which is housed in the drive unit 53. In the position of the drive unit 53, depicted in FIG. 8 the output gear wheel 56 meshes with a stationary toothed rack 57.

Figure 9:
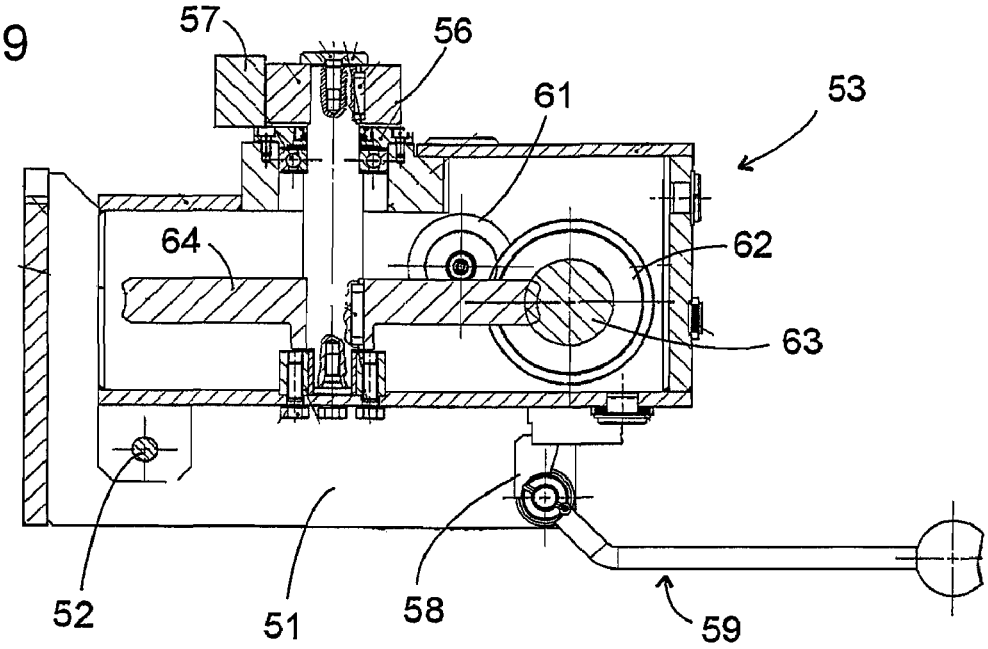

FIG. 9 shows a cross-section through the drive mechanism depicted in FIG. 8. The drive unit 53 is supported by a projection 58 of a pivot lever handle 59 which is hinged on one of the arms 51. The gear wheel 56 is maintained in engagement with the toothed rack 57 by this support of the drive unit 53. If the pivot lever handle 59 were lifted, the drive unit 53 could pivot in a clockwise direction around the shaft 52 and in this way could move the gear wheel 56 out of the toothed rack 57. This will cancel the non-positive connection between the electric motor 54 and the toothed rack 57.

A drive gear wheel 61, which is directly driven by the electric motor 54 and which meshes with a larger driven gear wheel 62, is located inside the drive unit 53. Driven gear wheel 62 is mounted on a common shaft together with a worm 63, which, in turn, meshes with a worm wheel 64. This worm wheel or gear 64 is mounted on a common shaft with the gear wheel 56. The worm 63 and the worm wheel 64 cause self-locking of the gear, by means of which the output gear wheel 56 is arrested when the electric motor 54 is switched off.

Figure 10:
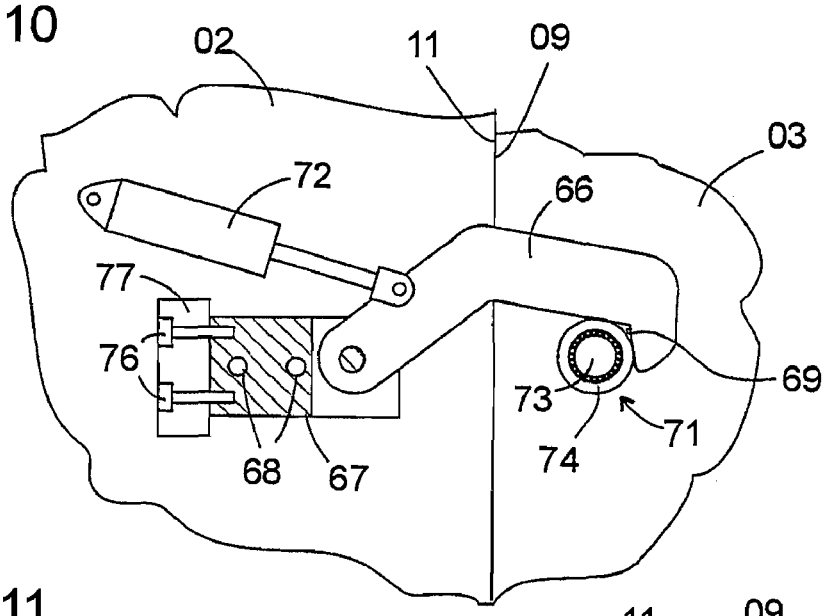

FIG. 10 shows a portion of one of the stationary lateral frame plates 02 and a portion of one of the movable lateral frame plates 03, whose vertical edges 09, 11 touch each other in the closed, engaged operating position of the printing unit. A mechanism for locking the lateral frame plates 02, 03 with each other in the operating position is shown in FIG. 10. This locking mechanism includes a pivotable hook 66, which is hinged to a forked bearing block 67, as is shown in section in FIG. 10. Two bores 68 are used for screwing or otherwise attaching the bearing block 67 on the lateral frame plate 02. These bores 68 permit limited horizontal play of the bearing block 67. In spite of measurement tolerances of the hook 66 and of the lateral frame plates 02, 03, this limited horizontal play allows the exact placement of the bearing block 67 in such a way that an interior flank 69 of the hook 66 extends around a locking protrusion 71 on the movable lateral plate 03 with exact contact. The radius of the interior flank 69 of the hook 66, in relation to the pivot shaft of the hook 66 on the bearing block 67, is slightly decreased in a counterclockwise direction. The interior flank 69 of hook 66 is thus capable of extending behind the locking protrusion 71, even if the edges 09, 11 of the lateral frame plates 02, 03 do not directly touch each other. The two lateral frame plates 02, 03 are then pulled against each other by pivoting the hook 66 in a clockwise direction until edges 09, 11 touch each other in the contact position shown in FIG. 10. The pivot movement of the hook 66 is driven by an actuating member 72, such as, for example, a pneumatic cylinder 72.

The locking protrusion 71 is constituted by a central pin 73, which is fixedly connected with the lateral frame plate 03, and by a roller 74 that is seated in a roller bearing and which is surrounding the pin 73. This roller 74 can turn or rotate when the hook 66 is pressed onto the locking protrusion 71, so that, in spite of the considerable tractive forces which the hook 66 can exert on the locking protrusion 71 in the course of pivoting of the hook 66, the movement of the hook 66 is not blocked by too much friction.

To prevent the bearing block 67 from slipping on the lateral frame plate 02 about its connection through bores 68, so that sufficient tractive force would no longer be able to be exerted on the locking protrusion 71, the bearing block 67 is additionally secured by two securing screws 76. These securing screws 76 are screwed into the bearing block 67 from the direction of a retaining block 77 which is rigidly fastened to the plate 02. FIG. 10 shows these two securing screws 76 tightened until they make contact, so that the bearing block 67 touches the retaining block 77. If the securing screws 76 are loosened a little, it is possible to place the bearing block 76 a little closer to the edge 09 and to fix it in place on the lateral frame plate 02 with the aid of screws entering into the bores 68.

Figure 11:
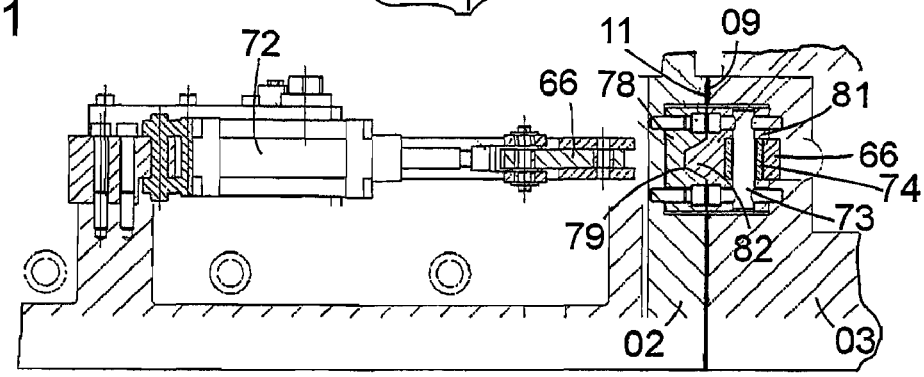

FIG. 11 shows the locking mechanism of FIG. 10 partially in a view from above and partially in cross-section. The pneumatic cylinder 72 and the hook 66, which it hingedly engages, can be seen. Two depressions have been formed at the touching edges 09, 11 of the lateral frame plates 02, 03. An insertion body 78, with a vertical cutout 79, such as, for example, a groove 79 of a trapezoidal cross section, is screwed into the depression of the lateral frame plate 02. An insertion body 81 with a protrusion 82, such as, for example, a rib 82 which positively engages the groove 79, is housed in the recess of the lateral frame plate 03. The insertion body 81 is simultaneously used as a support for the pin 73 and for the roller 74 of the locking protrusion 71.

The rib 82 and the cooperatively shaped groove 79 provide an exactly flush alignment of the lateral frame plates 02, 03, with respect to each other, transversely to the movement direction of the movable frame element 15 when they touch each other in the closed, engaged operating position of the printing unit. In order to avoid redundancy, insertion bodies 81 with the groove 79 and rib 82 are only provided at one of the two lateral frame plates 02, 03 of the stationary frame element 14 or the movable frame element 15, respectively. The insertion bodies which are attached to the other respective lateral frame plate 02, 03 are flat on their facing sides. The rib 82 and the groove 79 permit a vertical movement of the lateral frame plates 02, 03 against each other in the course of the transition of the rollers 07 between the retracted and the extended positions.

Figure 12:
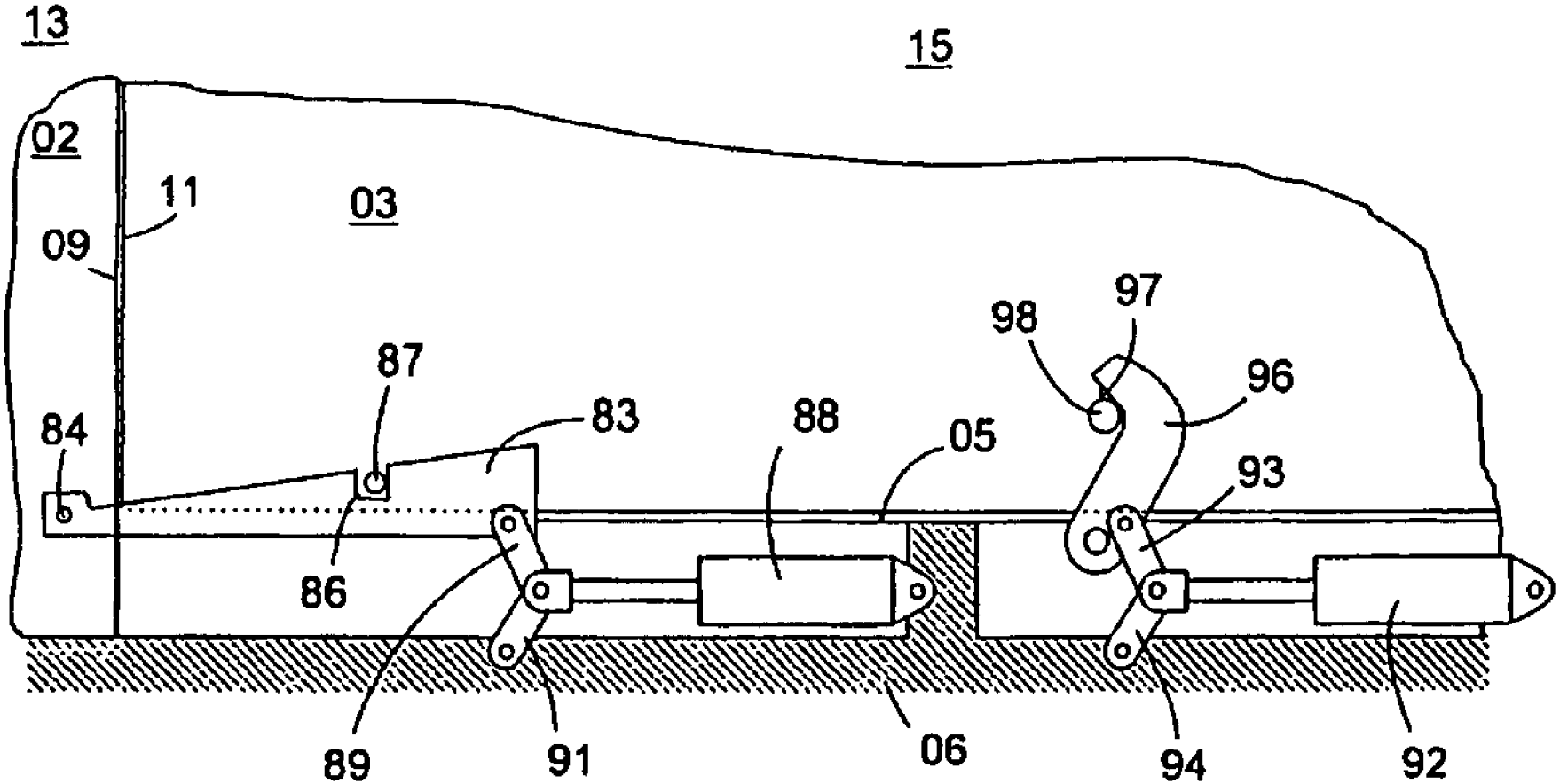

FIG. 12 shows two hooks 83, which are respectively provided in pairs on the two lower supports 06 of the main press frame. A first hook 83, which is formed with a ramp-shaped upper side, is pivotable around a shaft 84 which is situated adjacent an edge 09 of the lateral frame plate 02 and which first hook 83 has a notch 86 on its upper side. This notch 86, in the locked state of the first hook 83, receives a locking protrusion 87 carried on the lateral frame plate 03. The structure of the locking protrusion 87 is the same as that of the locking protrusion 71 discussed above. An actuating member 88, such as, for example, a pneumatic cylinder 88, which is mounted, substantially horizontally oriented, on the lower support 06 of the main press frame, is used for locking and unlocking the hook 83. The piston rod of the pneumatic cylinder 88 is hinged to a first rod 89, which acts on the hook 83, and to a second rod 91, whose second end is, in turn, hinged to the support 06 and which second rod 91 forms an angle with the first rod 89. When the piston rod is retracted from the extended position represented in FIG. 12, the angle between the first and second rods 89, 91 is reduced. The result is that the point of engagement of the rod 89 at the hook 83 is lowered, and the locking protrusion 87 is released. The movable frame member 15 can now be shifted.

In a manner which is the same as discussed in connection with the pneumatic cylinder 88, a second actuating member 92, such as, for example, a pneumatic cylinder 92, is substantially horizontally oriented on the support 06. Pneumatic cylinder 92 has a piston rod which acts via two rods 93, 94, which are angled in relation to each other in a manner similarly to the rods 89, 91, on the support 06 and on a second hook 96. Like the first pivotable hook 66, this second pivotable hook 96 has an interior flank 97 which flank 97, in the course of extending the second hook 96, slides along a locking protrusion 98 of the lateral frame plate 03 and, in the process, exerts a tractive force on the locking protrusion 98, which tractive force is directed downward and in the direction toward the lateral frame plate 02. This tractive force becomes larger the closer the hook 96 is to its contact position represented in FIG. 12. The hook 96 thus exerts a double locking function. For one, it keeps the lateral frame plate 03 pressed against the lateral frame plate 02. It also maintains the frame plate 03 fixed on the support 06.

The three pivotable hooks 66, 83, 96 can each be actuated by the use of a toggle lever, for example.

Figure 13:
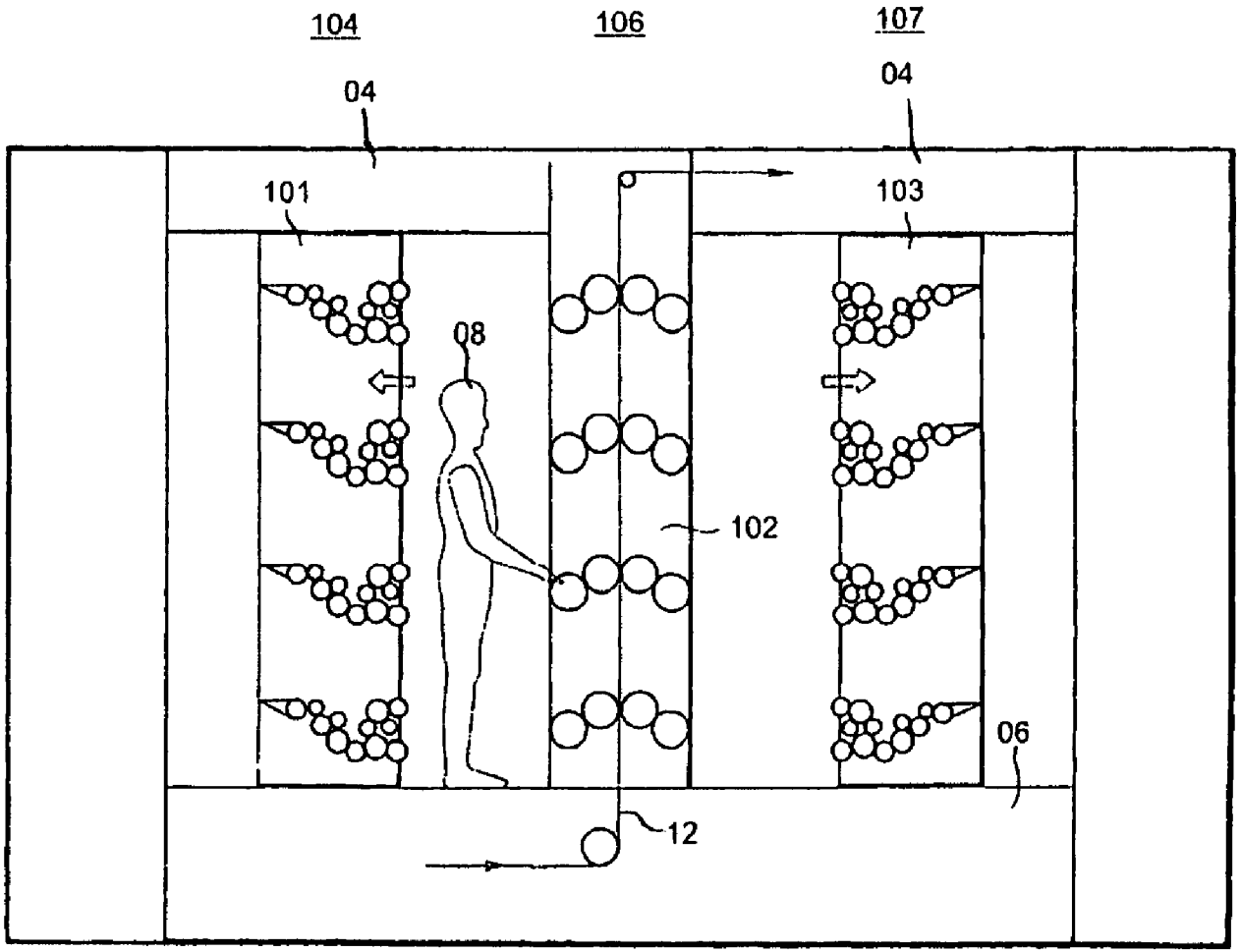
Figure 14:
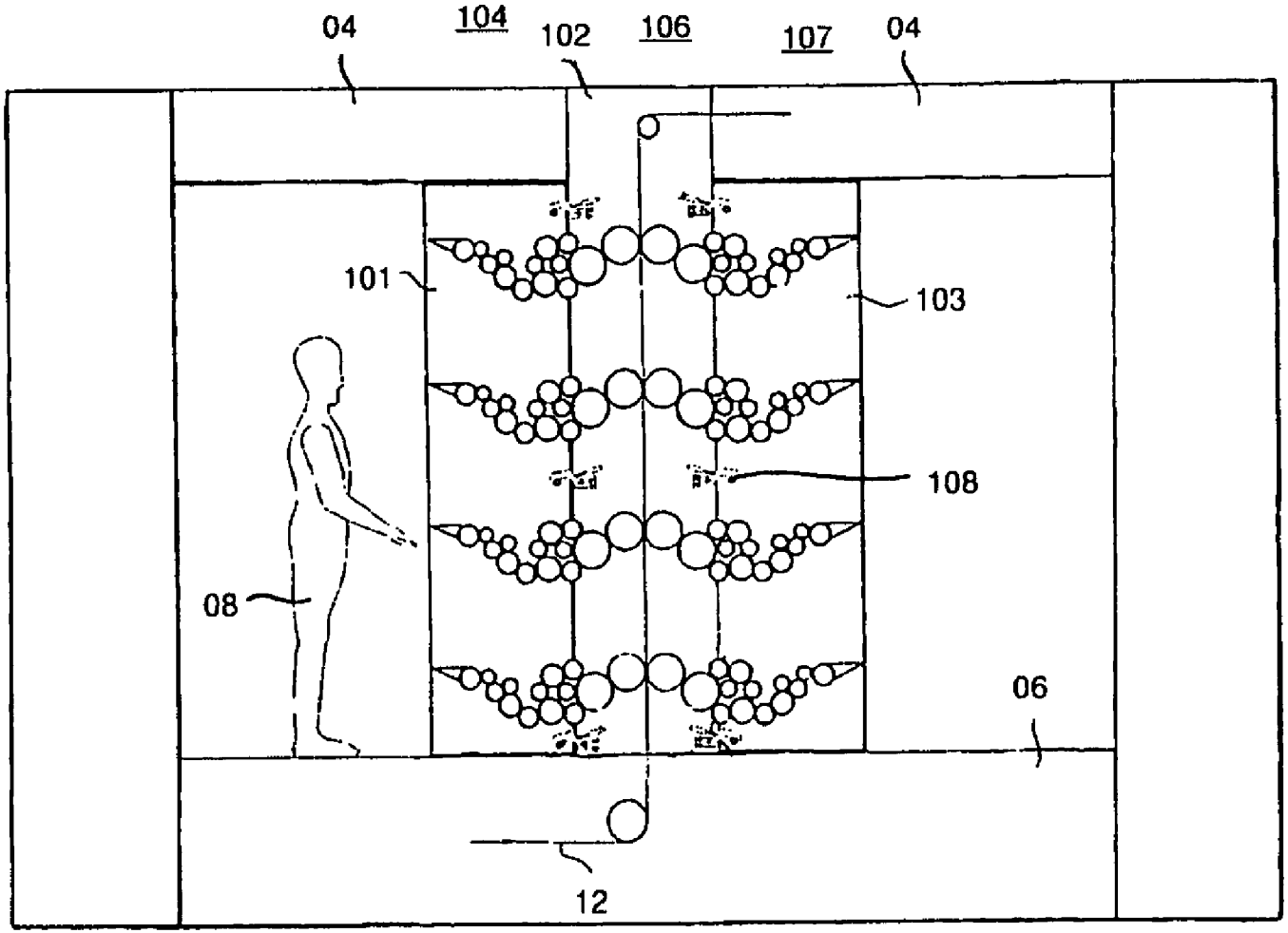

In another preferred embodiment of the present invention, as seen in FIG. 13 and in FIG. 14, the printing unit has three frame elements 104, 106, 107, wherein forme cylinders and transfer cylinders are arranged in the center frame element 106. Inking systems, which are assigned to the forme cylinders, are arranged in the two outer frame elements 104 and 107.

As represented in FIG. 13, the two outer frame elements 104 and 107 can be moved into a maintenance or set-up position, so that an accessible space between them and the fixed, center frame element 106 is provided.

The combined, closed, operating state of these three frame elements 104, 106, 107 as represented in FIG. 14 is the production position, i.e. the position in which the printing unit prints. In the course of coming into this production position, the three frame elements 104, 106, 107 are connected with each other by the use of a locking device 108. Six such locking devices 108 are represented in FIG. 14.

In the depicted preferred embodiment, the center frame element 106 has at least two pairs of cylinders arranged as a bridge printing group, but preferably has four bridge printing groups which are arranged to work together vertically.

The forme cylinders of the several disclosed preferred embodiments preferably have at least two printing plates in the axial direction, and preferably have four printing plates.

While preferred embodiments of movable frame parts in a printing press, in accordance with the present invention, have been fully and completely described hereinabove, it will be apparent to one of skill in the art that various changes in, for example, the drive motors for the various cylinders and rollers, the type of material web being printed, and the like could be made without departing from the true spirit and scope of the subject invention which is to be limited only by the appended claims.

What is claimed is:

1. A printing unit of a printing press comprising:

a first frame element and a second frame element;

means for supporting at least one of said first frame element and said second frame element for movement in a horizontal movement direction, between a closed position and an open position, to vary a horizontal spacing distance between said first and second frame elements;

first and second laterally spaced frame plates forming said first frame element;

third and fourth laterally spaced frame plates forming said second frame element;

at least a first cylinder extending between, and being supported by said first and second laterally spaced frame plates, said first and second frame plates being spaced laterally apart from each other in a direction of an axis of rotation of said first cylinder;

at least a second cylinder extending between, and being supported by said third and fourth laterally spaced frame plates, said third and fourth frame plates being spaced laterally apart from each other in a direction of an axis of rotation of said second cylinder;

at least first, second and third cooperating locking devices on each of said first and second frame elements, each of said at least first, second and third locking devices on each of said first frame elements being adapted to cooperate with an associated one of said at least first, second and third locking devices on each of said second frame elements and to fix said frame plates of said first and second frame elements in place when said first and second frame elements are abutting each other in response to said movement of at least one of said first and second frame elements into said closed position in said horizontal movement direction; and a first transverse centering element on one of said first and second laterally spaced frame plates of said first frame element and a second transverse centering element on a cooperating one of said third and fourth laterally spaced frame plates of said second frame element, said first transverse centering element including a tapered protrusion and being adapted to cooperate with a cooperatively shaped tapered cutout of said second transverse centering element to form a single transverse centering device which is usable to transversely align said adjacent ones of said first and second frame elements in a direction transverse to said horizontal movement direction when said tapered protrusion is moved into engagement with, and is received in said cooperatively shaped tapered cutout during said movement of at least one of said first frame element and said second frame element in said horizontal direction into said closed position, said first and second transverse centering elements being adapted to allow relative vertical movement between said first frame element and said second frame element.

2. The printing unit of claim 1 wherein at least one of said first and second frame elements has four of said cylinders arranged on top of each other.

3. The printing unit of claim 2 wherein one of said locking and centering devices is positioned between second and third ones of said four cylinders arranged on top of each other.

4. The printing unit of claim 1 wherein said at least first, second and third locking devices are arranged vertically with respect to each other.

5. The printing unit of claim 1 wherein at least eight forme cylinders and eight transfer cylinders are arranged in said printing unit.

6. The printing unit of claim 1 further including at least six of said locking devices in said printing unit.

7. The printing unit of claim 1 further including at least twelve of said locking devices in said printing unit.

8. The printing unit of claim 1 further including means causing each of said at least first, second and third locking devices to exert a tractive force in a direction of said movable frame element.

9. The printing unit of claim 1 wherein said single transverse centering device and one of said locking devices are located directly adjoining each other.

10. The printing unit of claim 1 further including means for moving at least one of said at least first and second frame elements vertically, said first and second laterally spaced lateral frame plates of said first frame element contacting said third and fourth laterally spaced lateral frame plates of said second frame element for vertical movement and being centered in said transverse direction by said single transverse centering device.

11. The printing unit of claim 1 further including additional frame elements wherein forme cylinders and transfer cylinders are arranged in one of said frame elements and inking systems are arranged in two others of said frame elements.

12. The printing unit of claim 1 including a printing group defined by said first and second frame elements, said first cylinder in said printing group being supported by a movable one of said first and second frame elements, said second cylinder in said printing group being supported by a stationary one of said first and second frame elements, and further including rollers supporting said movable frame element.

13. The printing unit of claim 8 wherein each of said at least first, second and third locking devices includes at least one hook and a locking protrusion engageable by said hook.

14. The printing unit of claim 13 wherein said locking protrusion includes a roller.

15. The printing unit of claim 13 wherein said hook is pivotable into and out of engagement with said locking protrusion.

16. The printing unit of claim 1 wherein each of said at least first, second and third locking devices includes a pivotable hook supported by a pivot shaft, said pivot shaft being adjustable on said frame element.

17. The printing unit of claim 1 wherein each of said at least first, second and third locking devices includes a pivotable hook and a toggle lever usable to pivot said hook.

18. The printing unit of claim 15 further including one of a pneumatic and hydraulic actuating member for pivoting said hook.

19. The printing unit of claim 15 including a pivot shaft for said hook on one of said frame elements and adjustable in said direction of said tractive force.

20. The printing unit of claim 19 wherein said one of said frame elements is a stationary frame element.

21. The printing unit of claim 20 wherein another of said frame elements is a movable frame element and further wherein said stationary frame element includes a support extending under said movable frame element, said movable frame element being displaceable along said support, said tractive force exerted by said at least one hook including a downwardly directed component.

22. The printing unit of claim 1 wherein said single transverse centering device is a trapezoidal centering device arranged in said axial direction of said cylinder.

23. The printing unit of claim 21 wherein said at least one locking device exerts a force extending in a vertical direction on said support.

24. The printing unit of claim 21 wherein said movable frame element is arranged on a running gear.

25. The printing unit of claim 24 wherein said running gear is usable to move said movable frame element vertically.

26. The printing unit of claim 1 wherein said tapered protrusion is a vertically oriented rib.

27. The printing unit of claim 26 wherein said tapered cutout is a vertically oriented groove.

28. The printing unit of claim 10 wherein said at least first, second and third locking devices cooperate to fix said adjacent frame plates in place in said vertical movement direction.

29. The printing unit of claim 28 wherein said single transverse centering device is usable to align said first and second frame elements in a direction which is transverse to said vertical movement direction.

* * * * *